US010551042B2

(12) United States Patent
Garvin

(10) Patent No.: US 10,551,042 B2
(45) Date of Patent: Feb. 4, 2020

(54) MULTIPURPOSE ADAPTABLE WORK LIGHT

(71) Applicant: Barton L. Garvin, Western Springs, IL (US)

(72) Inventor: Barton L. Garvin, Western Springs, IL (US)

(73) Assignee: Southwire Company, LLC, Carrollton, GA (US)

( * ) Notice: Subject to any disclaimer, the term of this patent is extended or adjusted under 35 U.S.C. 154(b) by 68 days.

(21) Appl. No.: 15/853,134

(22) Filed: Dec. 22, 2017

(65) Prior Publication Data

US 2019/0195477 A1 Jun. 27, 2019

(51) Int. Cl.

| | |
|---|---|
| ***F21V 21/08*** | (2006.01) |
| ***F21V 15/02*** | (2006.01) |
| ***F21V 21/096*** | (2006.01) |
| ***F21V 21/06*** | (2006.01) |
| ***F21V 15/01*** | (2006.01) |
| ***F21V 21/088*** | (2006.01) |
| ***F21W 131/402*** | (2006.01) |

(52) U.S. Cl.

CPC ..... *F21V 21/08* (2013.01); *F21V 15/01* (2013.01); *F21V 15/02* (2013.01); *F21V 21/06* (2013.01); *F21V 21/088* (2013.01); *F21V 21/096* (2013.01); *F21W 2131/402* (2013.01)

(58) Field of Classification Search

CPC ..... F21V 21/08; F21V 21/088; F21V 15/01; F21V 21/06; F21V 21/096; F21V 15/02; F21W 2131/402

See application file for complete search history.

(56) References Cited

U.S. PATENT DOCUMENTS 1,978,882 A * 10/1934 Olley ..... F21V 17/101 174/559
3,626,424 A * 12/1971 Kahn ..... F21V 15/02 362/218
4,288,848 A * 9/1981 Fido ..... F21L 14/00 362/378
4,298,922 A * 11/1981 Hardwick ..... F21L 14/02 362/376
4,321,660 A * 3/1982 Sokol ..... F21L 14/02 362/368

(Continued)

*Primary Examiner* — Tsion Tumebo
(74) *Attorney, Agent, or Firm* — David G. Rosenbaum; Benjamin D. Rotman; Rosenbaum IP, P.C.

(57) ABSTRACT

The present invention is directed to a multipurpose adaptable work light, system, and method of use. The invention comprises a first housing member having an external connection port, a second housing member coupled to the first housing member, a lighting device coupled to the first housing member and disposed within the second housing member, a power source coupled to the lighting device, at least one magnet coupled to the first housing member, and an adaptor plate coupled to the first housing member. Each of the at least one magnet, the adaptor plate, the external connection port, and the second housing member may be utilized in various tandem and independent configurations in order to affix the work light to a suitable workplace environment surface, such as an overhead hook support, a tripod mount, a magnetically-active surface, a junction box, or to a wide variety of surfaces, including, without limitation, horizontal, vertical, angled, flat or curved surfaces.

12 Claims, 7 Drawing Sheets

(56) References Cited

U.S. PATENT DOCUMENTS 5,213,412 A * 5/1993 Ciallella ..... F21L 15/14 362/396
5,349,511 A * 9/1994 Henderson ..... F21L 15/14 362/396
D359,139 S * 6/1995 Kaczmarek ..... D26/119
5,448,463 A * 9/1995 Leen ..... F21L 14/00 362/263
6,062,703 A * 5/2000 Tsao ..... F21L 14/026 362/184
7,229,185 B1 * 6/2007 Galvez ..... F21L 14/023 362/109
8,303,142 B2 * 11/2012 Bryant ..... F21L 4/08 362/184
8,870,414 B2 * 10/2014 Goeckel ..... F21V 7/00 362/249.03
D829,363 S * 9/2018 Lan ..... D26/119
10,145,555 B2 * 12/2018 Ohai ..... F21V 31/005
2003/0035287 A1 * 2/2003 Kovacik ..... F21L 14/023 362/223
2005/0063179 A1 * 3/2005 Niemann ..... F21L 4/027 362/184
2005/0135108 A1 * 6/2005 Delano ..... F21V 21/0885 362/396
2006/0034091 A1 * 2/2006 Kovacik ..... F21L 14/023 362/398
2006/0109662 A1 * 5/2006 Reiff ..... F21L 4/04 362/373
2006/0139927 A1 * 6/2006 Kovacik ..... F21V 29/74 362/260
2008/0130277 A1 * 6/2008 Waters ..... F21L 4/00 362/227
2009/0135607 A1 * 5/2009 Holloway ..... F21V 25/12 362/362
2009/0147519 A1 * 6/2009 Klipstein ..... F21L 14/023 362/249.02
2010/0061111 A1 * 3/2010 Hedrick ..... F21L 14/02 362/398
2010/0182777 A1 * 7/2010 Van Deursen ..... F21L 4/04 362/184
2012/0092881 A1 * 4/2012 Ohai ..... F21V 1/00 362/433
2012/0195041 A1 * 8/2012 Fletcher ..... F21V 15/01 362/249.02
2013/0094196 A1 * 4/2013 Wessel ..... F21L 4/04 362/198
2014/0036511 A1 * 2/2014 Whitfield ..... F21V 27/005 362/311.02

* cited by examiner

MULTIPURPOSE ADAPTABLE WORK LIGHT

BACKGROUND OF THE INVENTION

The present invention relates to work lights or shop lights used on a work or construction site. Specifically, this invention relates to a work light system adapted to be mounted to or hung from many common places in a workplace environment.

Standard construction light fixtures vary in degrees of proprietary function. Numerous models of lighting systems are designed to be solely mounted on a tripod, while other models contain a series of hooking mechanisms to aid in hanging the light fixture overhead. Construction professionals must invest significant time and money planning and implementing a safe and properly lit workplace environment for various on-hand projects. Retaining such an arsenal of specific light fixtures designed for specific and constrictive functions may lead to wasted time, effort, and finances.

Additionally, where a given workplace environment provides no suitable structures or surfaces to accommodate the necessary work light fixtures, construction professionals may be forced to improvise lighting schema, many times utilizing work light fixtures that would normally require a support structure in potentially dangerous configurations, such as lining the ground of a workplace area with work lights designed to function as hanging lights. This type of practice can lead to numerous workplace hazards such as masses of electrical cables sprawled along footpaths or an overall inadequately lit workplace environment.

The present invention seeks to provide solutions to the aforementioned problems by providing a multipurpose, adaptable work light system capable of being mounted to various locations within a typical workplace environment. The work light system may be configured to hang from overhead structures via hooks, coupled to a tripod structure, fastened to magnetically-active surfaces via magnets coupled thereto, or may function as a freestanding light fixture.

SUMMARY OF THE INVENTION

The present invention is directed to a work light system configured to be mounted to or hung from multiple locations in a typical workplace environment. In one embodiment the work light system comprises a first housing member having an external connection port, a second housing member coupled to the first housing member, a lighting device coupled to the first housing member and disposed within the second housing member, a power source coupled to the lighting device, at least one magnet coupled to the first housing.

An additional aspect of the system may include an adaptor plate configured to adapt the external connection port from a first connection type such as a particular threaded pitch or diameter size to at least a second particular threaded pitch or diameter size.

Another additional aspect of the system may include a hook or similar connection device like a carabiner threaded at one end configured to be coupled to the external connection port in order to hang the system in the workplace environment.

Yet another additional aspect of the system may include a junction box device ring coupled to the external connection port configured to mount the system to an existing junction box in the workplace environment.

The first housing member generally comprises a first end and a second end. The first end further comprises at least one magnet configured to support the weight of the work light as well as an external connection port configured to accommodate external connection devices including, but not limited to, adaptor plates, hooks, tripods, and junction box device rings. In some embodiments, the lighting device is coupled to the second end. The second housing member is coupled to the second end of the first housing member. In some embodiments, the second housing member is configured as a cage to surround and protect the lighting device. The second housing member may further comprise longitudinal and lateral support members configured to be engaged by a hook member and hung in the work place environment.

In some embodiments the first housing comprises an industry standard thermoplastic including, but not limited to, ABS or polycarbonate.

In some embodiments the second housing may comprise an industry standard metal such as steel, stainless steel, or galvanized steel, aluminum or an industry standard plastic polymer such as ABS, fiberglass, polycarbonate or polystyrene.

The lighting device may comprise a standard light bulb and light socket wired to an external power source, or may comprise an array of LEDs coupled to an external power source. Embodiments using LEDs may additionally comprise heat sinking members configured to dissipate heat emanating from the LEDs.

In some configurations, the external connection port is threaded to accommodate a threaded external component such as a hook, adaptor plate, or device ring.

In still other configurations, the external connection port is an electrical power connection electrically coupled to an electrical power supply.

The methods, systems, and apparatuses are set forth in part in the description which follows, and in part will be obvious from the description, or can be learned by the practice of the methods, apparatuses, and systems. The advantages of the methods, apparatuses, and systems will be realized and attained by means of elements and combinations particularly pointed out in the appended claims. It is to be understood that both the foregoing general description and the following detailed description are exemplary and explanatory only and are not restrictive of the methods, apparatuses, and systems, as claimed. More details concerning these embodiments, and others, are further described in the following figures and detailed description set forth herein below.

BRIEF DESCRIPTION OF THE DRAWINGS

In the accompanying figures, like elements are identified by like reference numerals among the several preferred embodiments of the present invention.

While the invention has been described in connection with various embodiments, it will be understood that the invention is capable of further modifications. This application is intended to cover any variations, uses or adaptations of the invention following, in general, the principles of the invention, and including such departures from the present disclosure as, within the known customary practice within the art to which the invention pertains.

DETAILED DESCRIPTION OF THE PREFERRED EMBODIMENTS

The foregoing and other features and advantages of the invention will become more apparent from the following detailed description of exemplary embodiments, read in conjunction with the accompanying drawings. The detailed description and drawings are merely illustrative of the invention rather than limiting, the scope of the invention being defined by the appended claims and equivalents thereof.

Figure 1A:
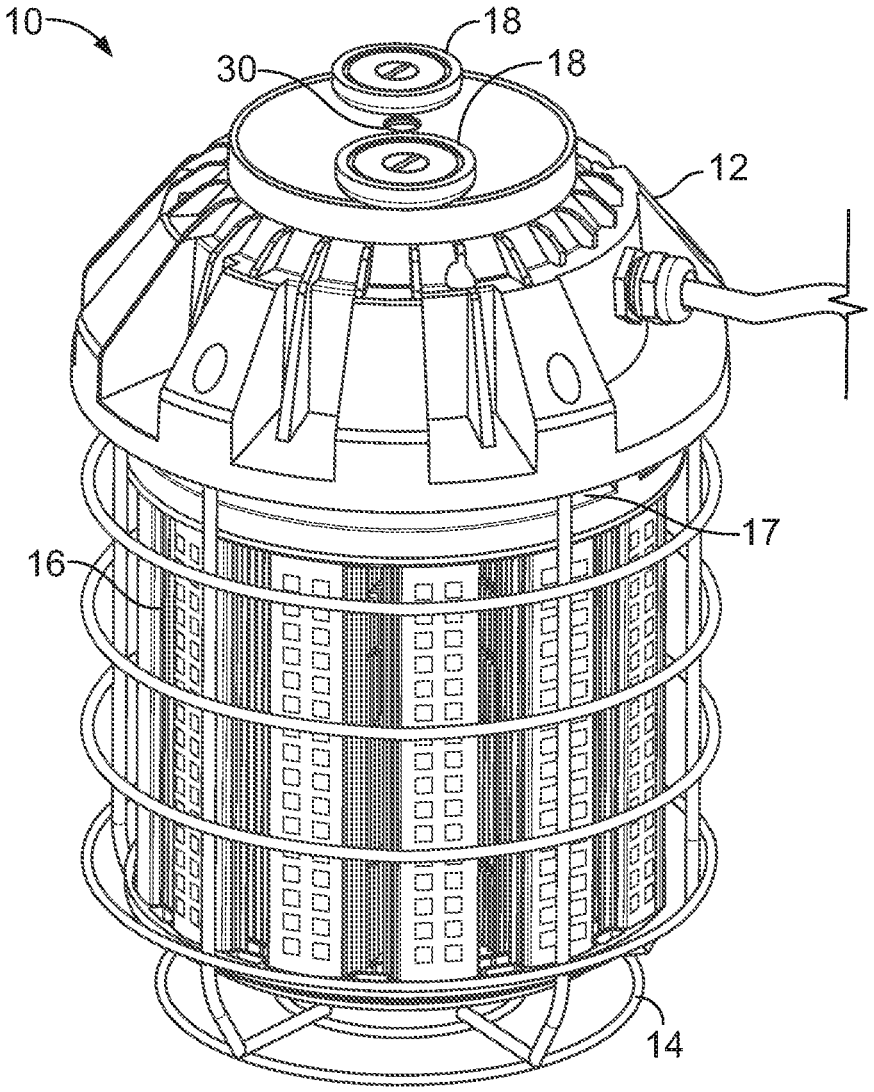
FIGS. 1A-1D are perspective views of an embodiment of a multipurpose adaptable work light system.
Figure 1B:
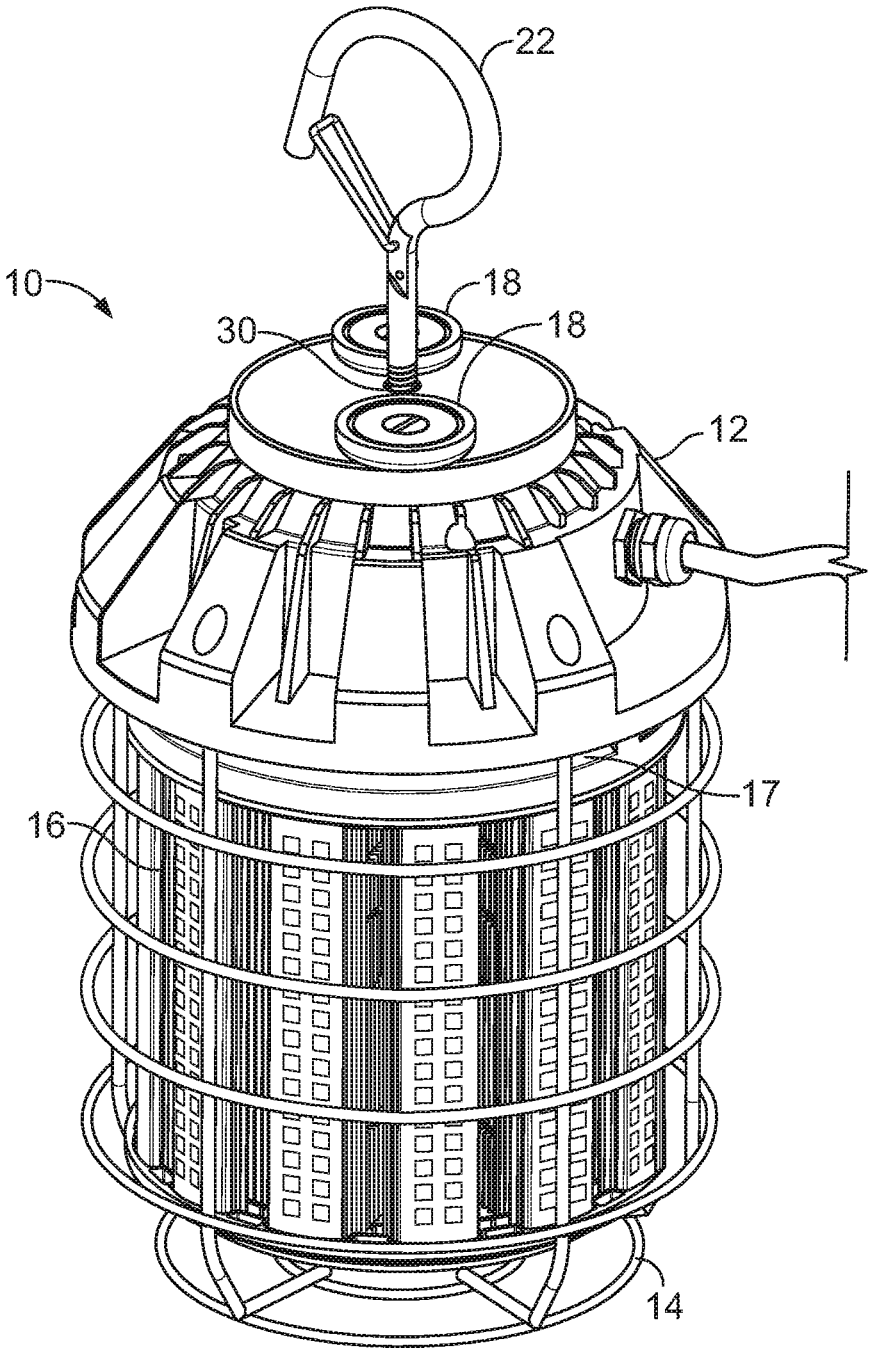
Figure 1C:
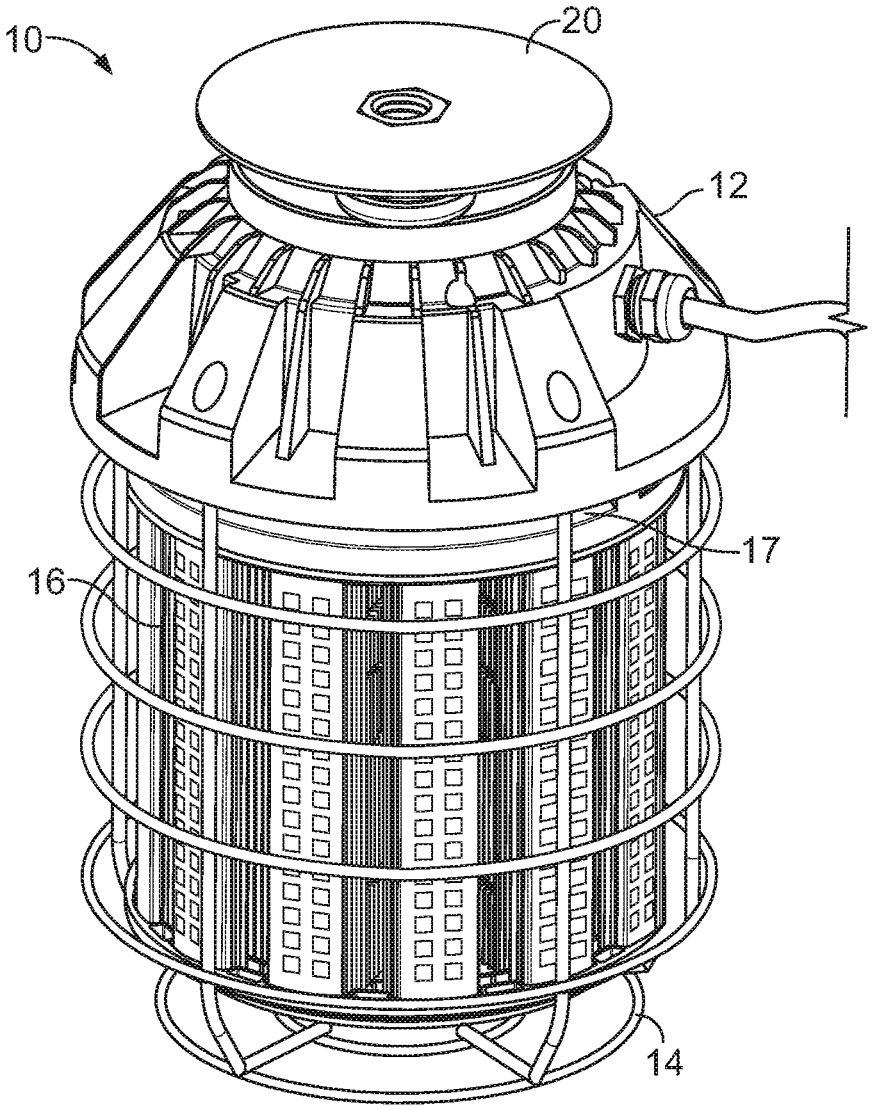
Figure 1D:
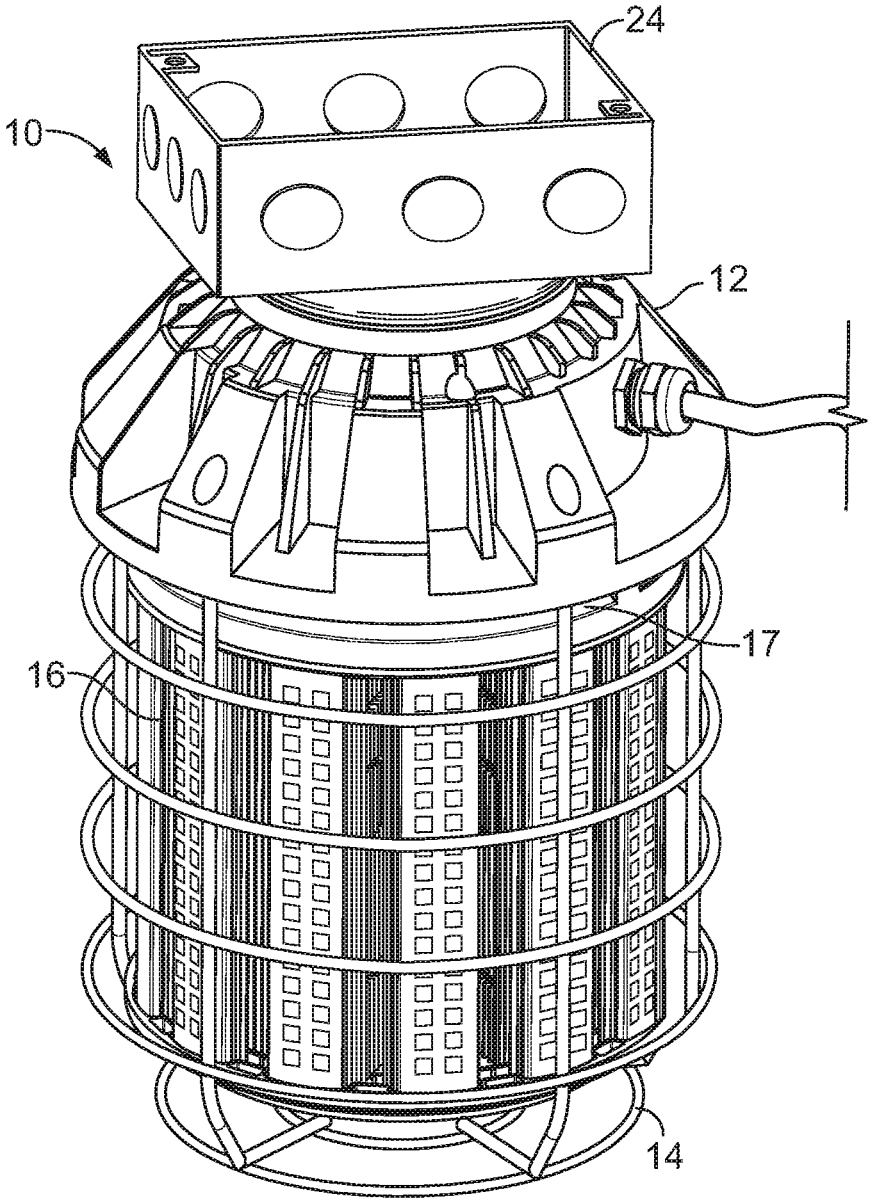

FIGS. 1A-1D show perspective views of a multipurpose adaptable work light system 10. FIG. 1A shows an embodiment of the work light system 10 that comprises a first housing member 12, a second housing member 14 coupled the first housing member 12, a lighting device 16 coupled to the first housing 12, a power cable coupled to the lighting device 16 through the first housing 12, and at least one magnet 18 coupled to the first housing 12. FIG. 1B shows the work light system 10 as described above, additionally with a hook 22 coupled to the first housing 12 instead of the adaptor plate 20. FIG. 1C shows the work light system 10 as described above, additionally with an adaptor plate 20 coupled the first housing 12. FIG. 1D shows the work light system 10 as described above, additionally with a device ring 24 coupled to the first housing 12 instead of the adaptor plate 20.

Figure 2A:
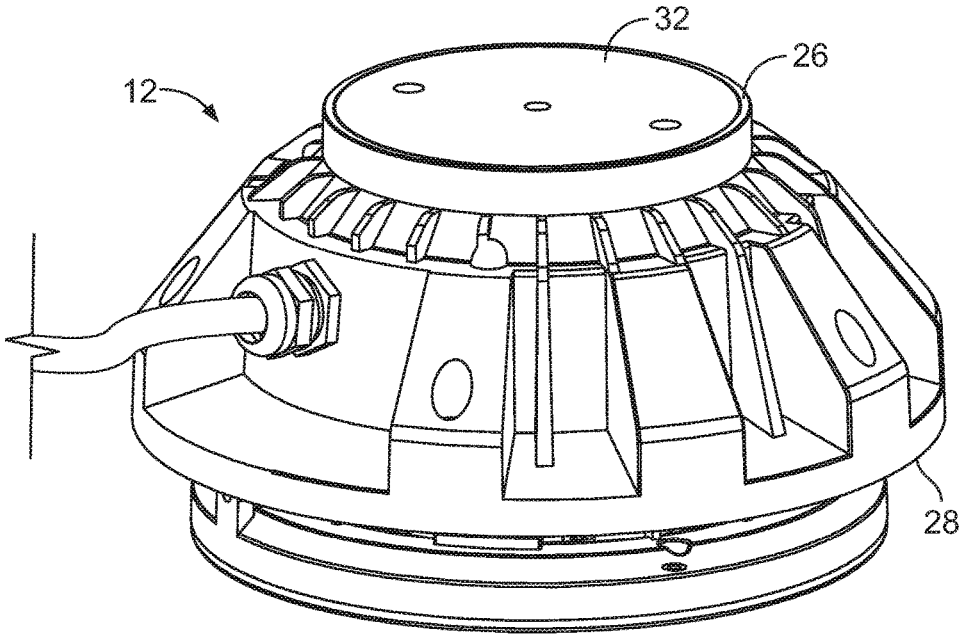
FIGS. 2A-2C show a perspective view and a top view of an embodiment of the first housing.
Figure 2B:
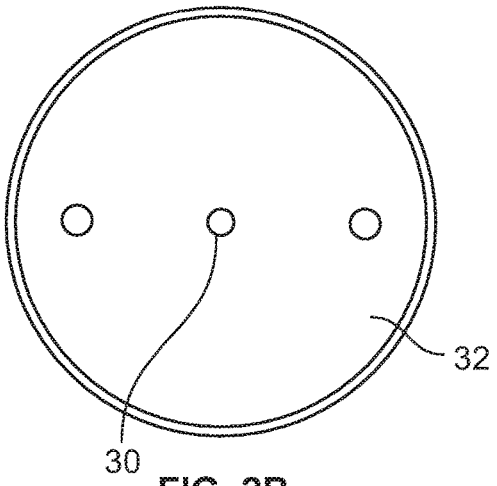

FIGS. 2A and 2B show a perspective view and a top view of the first housing member 12. The first housing member 12 generally comprises a first end 26 and a second end 28. The first end 26 further comprises a least one magnet 18 configured to support the weight of the work light 10 and/or have pull strength of at least 90 LBS (41 KGS) as measured by Standard MDFA 101 95 developed by the Magnet Distributor and Fabricators Association. In some embodiments the at least one magnet 18 is coupled to an external surface 32 of the top end 26 whereas in other embodiments, the at least one magnet 18 is embedded beneath the external surface 32 or the external surface 32 is itself magnetic and is the at least one magnet 18. The at least one magnet 18 allows the work light system 10 to be mounted to a magnetic surface in a workplace environment including, but not limited, to ferromagnetic or paramagnetic materials such those used to manufacture construction components such as, for example, structural steel, ducts, or metal conduits.

The top end 26 of the first housing member 12 may also comprise an external connection port 30 configured to accommodate at least one external connection device. In some embodiments, the external connection port 30 may comprise a threaded opening embedded into the external surface 32, while in other embodiments the external connection port 30 may comprise snapping or locking features common to one of skill in the mechanical arts.

Figure 3A:
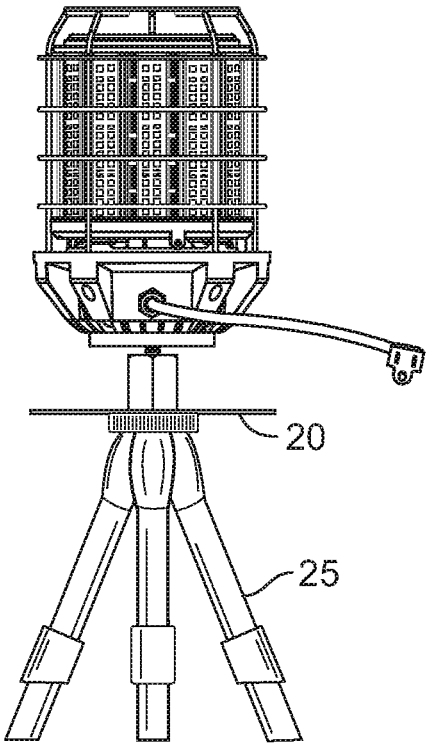
FIGS. 3A-3B are partial cross-sectional views of an embodiment of the multipurpose adaptable work light system with an adapter plate installed.
Figure 3B:
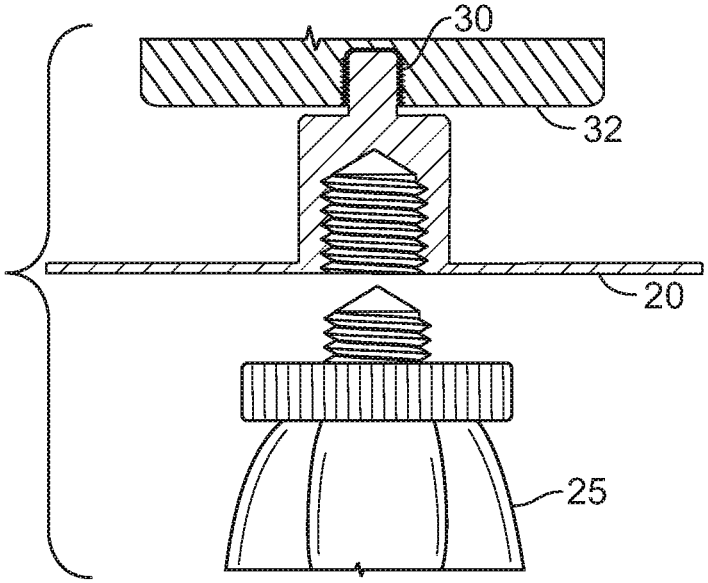

An adaptor plate 20, may be used to expand the size or type of external connection port 30. For example, one embodiment of the adaptor plate 20 as shown in FIGS. 3A and 3B may couple to a threaded ¼" diameter connection port 30, and raise and expand the connection port 30 to accommodate a mounting commercial mounting tripod with a ⅝" threaded male portion. One of skill in the art would understand that the adaptor plate 20 could be used to accommodate different industry standard threading diameters and pitches or could be used to convert a threaded connection port 30 to a snap-and-lock connection port 30 or vice versa.

External connection devices may include but are not limited to adaptor plates 20, hooks 22, tripods 25, and junction box device rings 24. A hook 22 may be coupled to the external connection port 30 allowing the work light system 10 to be hung from anywhere in the workplace environment including, but not limited to, another hook, conduit, or netting. A tripod may be used to mount the system 10 to an elevated level and maintain portability of the system 10, while a junction box device ring 24 would allow for the system to be mounted directly to a junction box in a workplace environment.

Figure 2C:
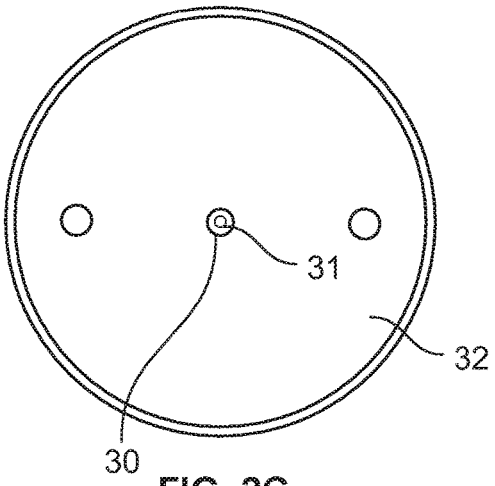

In additional embodiments as shown in FIG. 2C, the external connection port 30 may comprise two concentric threaded ports 30, 31. In these embodiments for example, a ⅝" threaded external connection port 30 is disposed on the external surface 32 of the top end 26 of the first housing member 12 and extends to a depth D into the first housing member 12. At the base of depth D an additional external connection port 31 having a smaller diameter such as a ¼", may extend an additional depth of D' allowing for coupling of devices with complementary threaded male ends.

In some embodiments of the system 10, the lighting device 16 is coupled to the second end 28. The lighting device 16 may comprise a standard light bulb and socket coupled to a power supply or may be an array of LEDs coupled to at least one heat sinking member. The lighting device 16 may include the components described above, or additionally may include the components assembled to a lighting housing 17 which is coupled to the first housing member 12. The lighting device 16 may be coupled to a power cable through the first housing member 12 and connected to an external power source or may be connected to an internal power supply coupled to or embedded within the first housing member 12.

Figure 5:
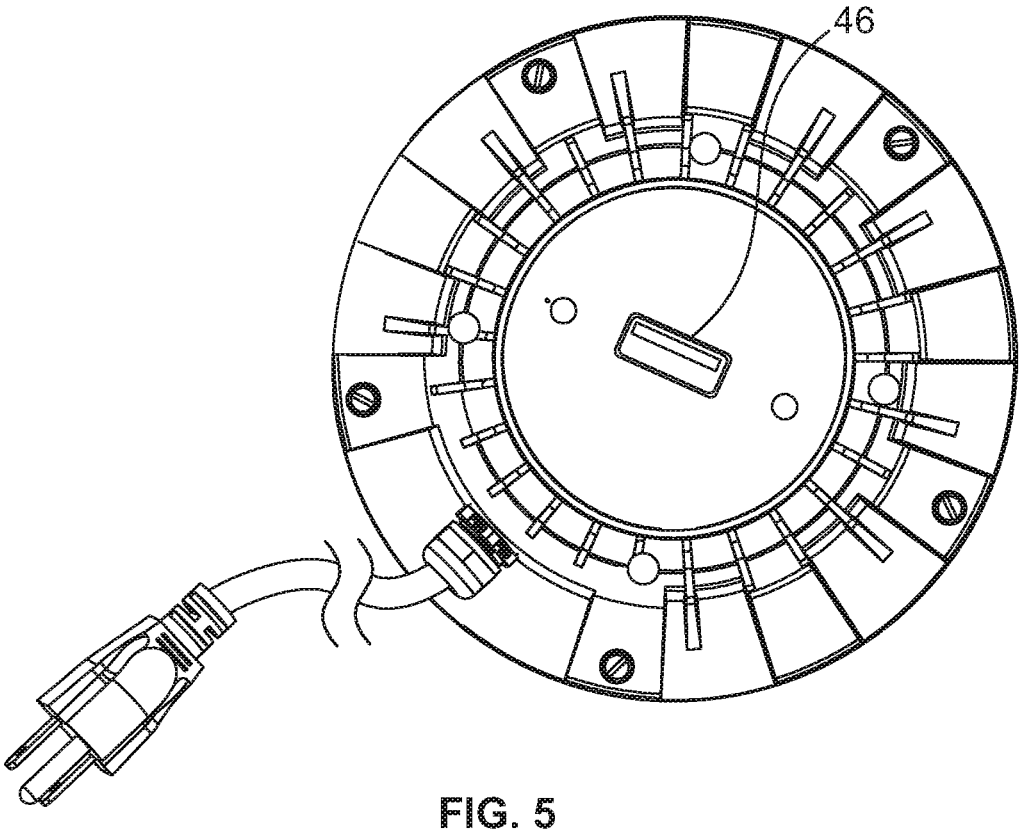
FIG. 5 shows a top view of an embodiment of the multipurpose adaptable work light system.

In yet a further embodiment as shown in FIG. 5, the external connection port 30 may comprise an electrical connector 46 coupled to the power supply. The electrical connector 46 may consist of a low voltage DC connector, a Universal Serial Bus (USB) connector, a LIGHTENING (Apple) connector, or a grounded or ungrounded AC male or female connector. In this manner the electrical connector 46 allows for serial connection of plural systems 10, connection and charging of mobile devices or powering of low voltage electrical systems.

The coupling of the first housing member 12 and lighting housing 17 may be configured to form a seal. An industry standard sealant or epoxy may be applied along the seam formed by the coupling of the two housing members, or the seal may be formed by example including, but not limited to, gaskets, chemical sealants, friction fit, adhesives, or a compression fit. The seal is configured to limit both water and dust from infiltrating the space between at least two coupled structural members. In embodiments wherein the lighting device 16 comprises the lighting housing 17 and an array of LEDs coupled thereto, the lighting housing 17 may comprise a seal around at least the portion of housing 17 that protects the array of LEDs. In some embodiments the seal is configured have an International Protection Rating of at least IP64 under ANSI/IEC 60529-2004 published by the National Electrical Manufacturers Association.

The first housing member 12 may be comprised of materials standard in the industry, including, but not limited to, thermoplastics such as ABS or polycarbonate. In some embodiments the external connection port 30 may be a metal threaded insert, while in other embodiments it may be a molded bore configured to accommodate a self-tapping screw or a molded bore having snapping features configured to accommodate an external connection device with complementary snapping features.

Figure 4:
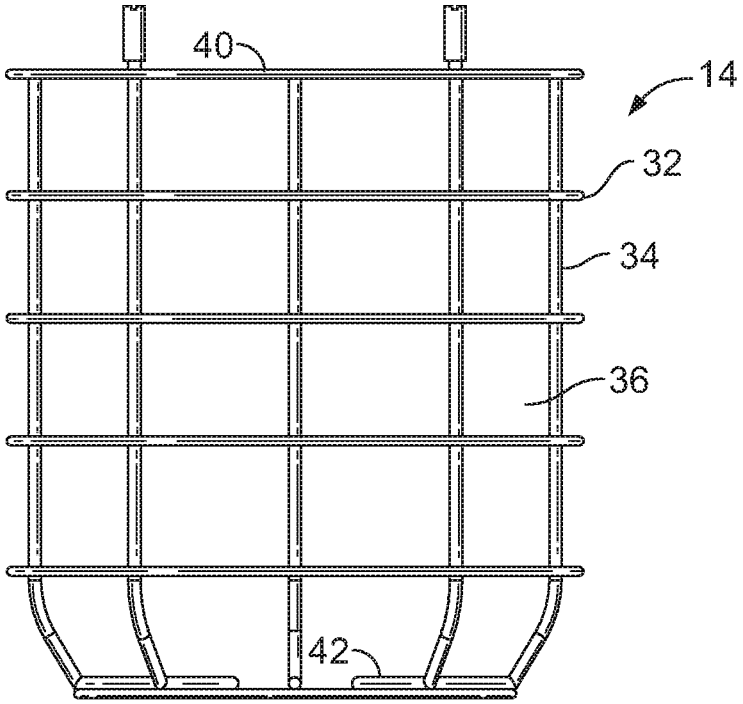
FIG. 4 shows a perspective view of the second housing member.

FIG. 4 shows a front view of the second housing member 14. The second housing member 14 is coupled to the second end 28 of the first housing member 12. The second housing member 14 is configured to surround and protect the lighting device 16. To protect the lighting device 16, the second housing member 14 may further comprise a plurality of longitudinal and lateral support members 32, 34 forming a cage-like structure having a series of openings 36 bound by the interlinking or interconnected longitudinal and lateral support members 32, 34. At a top end 38, the second housing member 14 has a receiving opening 40 bound by a lateral support member 34, of the plurality of lateral support members 34. The receiving opening 40 is configured with a circumference sized to accommodate the lighting device 16. At a bottom end 40 of the second housing member 14, a portion 42 of at least some of the plurality of longitudinal support members 32 extends substantially normal to the rest of the body of the longitudinal support member 32, forming a substantially flat bottom end 40. In some embodiments, an additional lateral support member 34 of the plurality of lateral support members 34 is coupled to the normal portion 42 of the plurality of longitudinal members to provide additional support and stability to the work light system 10 when disposed onto a flat surface.

In some embodiments of the work light system 10, at least one of the series of openings 36, forming a cage-like enclosure. The cage-like enclosure is formed by interlinking or interconnected a plurality of lateral and longitudinal support members 32, 24 is configured with a surface area large enough to accommodate a hook 22. In these embodiments, a hook 22 or similar device such as a carabiner or rope may be disposed through at least one of the openings 36 and secured onto at least one of the plurality of lateral or longitudinal support members 32, 34. This allows the work light system 10 to be coupled to and hang from multiple sources in a workplace environment.

The second housing member 14 may be comprised of materials standard in the industry, including, but not limited to, metals such as steel, stainless steel, or galvanized steel, aluminum or polymers such as ABS, fiberglass, polycarbonate or polystyrene. The second housing member 14 may be configured as a cage-like structure coupled to the first housing member 12 encompassing the lighting device 16, forming a protective enclosure around the lighting device 16.

Those of ordinary skill in the art will understand and appreciate the foregoing description of the invention has been made with reference to certain exemplary embodiments of the invention, which describe a work light system and method of use. Those of skill in the art will understand that obvious variations in construction, material, dimensions or properties may be made without departing from the scope of the invention which is intended to be limited only by the claims appended hereto.

What is claimed:

1. An adaptable work light, comprising:

a. a first housing member having a first end with a top external surface, and a second end with a bottom surface;

b. at least one magnet coupled to the top external surface;

c. an external connection port comprising a ¼" diameter disposed within the top external surface, the external connection port configured to accommodate at least one adaptor plate configured to be coupled to the external connection port, the adapter plate further having a second external connection port comprising a ⅝" diameter;

d. a lighting device coupled to the bottom surface of the first housing;

e. a second housing member coupled to the second end of the first housing member and enclosing the lighting device, the second housing member being configured to protect the lighting device and allow light transmission from the lighting device through the second housing member; and f. a power source coupled to the lighting device.

2. The adaptable work light of claim 1, wherein the external connection port further comprises a threading configured to accept at least one complementary threaded member or latching features configured to accept an external device with complimentary hooking or snapping features.

3. The adaptable work light of claim 1, wherein the first housing member further comprises a power supply connector electrically coupled to the power source.

4. The adaptable work light of claim 1, wherein the adaptor plate further comprises an extension member configured extend the second external connection above the at least one magnet when coupled to first housing member.

5. The adaptable work light of claim 4, wherein a flange projects from the extension member and is configured to provide additional stability or cover for the at least one magnet.

6. The adaptable work light of claim 1, wherein the first housing member further comprises a hook member configured to allow the adaptable work light to hang from a workplace structure.

7. The adaptable work light of claim 1, wherein the adaptable work light further comprises a tripod coupled to the second external connection port.

8. The adaptable work light of claim 1, wherein the adaptable work light further comprises a device ring configured to couple the adaptable work light to a junction box.

9. The adaptable work light of claim 1, wherein the top external surface is magnetic and comprises the at least one magnet.

10. The adaptable work light of claim 1 wherein the second housing member comprises at least one opening bounded by the intersection of the plurality of intersecting longitudinal and latitudinal support members, the at least one opening configured to accommodate a hook disposed there through, the plurality of intersecting longitudinal and latitudinal support members configured to support the weight of the adaptable work light when coupled to a hook.

11. The adaptable work light of claim 1, wherein the second housing member further comprises a cage member.

12. The adaptable work light of claim 1, wherein the second housing member further comprises a light transmissive protective housing.

* * * * *